United States Patent [19]

Sato et al.

[11] Patent Number: 5,060,424

[45] **Date of Patent: * Oct. 29, 1991**

[54] SURFACE GRINDING APPARATUS

[75] Inventors: Takesi Sato; Kenichi Mitsuhashi, both of Ibaraki; Yoji Tomita, Tochigi; Yasuoki Sasaki, Ibaraki, all of Japan

[73] Assignee: Kanebo Limited, Tokyo, Japan

[ * ] Notice: The portion of the term of this patent subsequent to Apr. 24, 2007 has been disclaimed.

[21] Appl. No.: 476,859

[22] Filed: Feb. 9, 1990

Related U.S. Application Data

[63] Continuation-in-part of Ser. No. 216,483, Jul. 8, 1988, Pat. No. 4,918,872, which is a continuation of Ser. No. 16,985, Feb. 19, 1987, abandoned, which is a continuation of Ser. No. 732,207, May 9, 1985, abandoned.

[30] Foreign Application Priority Data

May 14, 1984 [JP] Japan ..... 59-97223

[51] Int. Cl.[5] ..... B24D 5/10

[52] U.S. Cl. ..... 51/209 R; 51/204; 51/267

[58] Field of Search ..... 51/209 R, 204, 206.4, 51/267

[56] References Cited

U.S. PATENT DOCUMENTS 4,918,872 4/1990 Sato et al. ..... 51/209 R

*Primary Examiner*—Maurina Rachuba

*Attorney, Agent, or Firm*—Armstrong, Nikaido, Marmelstein, Kubovcik & Murray

[57] ABSTRACT

A surface grinding apparatus in which a work piece having a plate-like, disc-like, circular or annular shape and having a flat surface and a uniform thickness, which is held by carrier plates between upper and lower horizontal surface tables confronting one another, is pressed against the upper and lower surface tables and the upper and lower surface table and carrier plates are slidably moved by different rotary actions to grind the work piece by sliding friction. In the apparatus, a plurality of resin bond grinding stones are attached to the upper and lower surface tables directly or through attaching plates so that both of the upper and lower acting surfaces constitute the same plane, the grinding stones are defined by a plurality of grooves formed to extend toward the outer side of the surface table from the inner side thereof in a direction opposite to the rotation direction of the surface table and communicate with the outer side of the surface table, and a plurality of radial grooves passing through an imaginary center of the surface table, the width of the grooves is at least 4 mm, the depth of the grooves from the grinding surface to the surface of the surface table is at least 5 mm, and the area ratio of the grinding stone-acting surface to the effective grinding surface is at least 50%.

2 Claims, 3 Drawing Sheets

SURFACE GRINDING APPARATUS

This application is a continuation-in-part application of copending application Ser. No. 216,483, filed July 8, 1988, now U.S. Pat. No. 4,918,872, patented Apr. 24, 1990 which in turn is a continuation of application Ser. No. 016,985, filed Feb. 19, 1987, now abandoned, which in turn is a continuation of application Ser. No. 732,207, filed May 9, 1985, now abandoned.

BACKGROUND OF THE INVENTION

1. Field of the Invention

The present invention relates to a surface grinding apparatus. More particularly, the present invention relates to a surface grinding apparatus for uniformly and efficiently grinding surfaces of various materials having a flat surface and differing in shape, such as plate-like and disk-like materials composed of metals, glass, synthetic resins, or the like.

2. Description of the Related Art

The surface grinding of metal plates, glass sheets, synthetic resin plates and the like is often performed by a lapping machine. Such a machine is provided with a plate-like lapping platen or a lapping platen having an artificial suede leather bonded thereto, and a material to be ground is pressed against the lapping platen, a grinding slurry containing abrasive grains is continuously supplied, and the material is slidingly moved on the lapping platen. Various lapping machines are known for performing such grinding operations, for example, a lapping machine in which a single lapping platen is rotated to effect grinding, and a lapping machine in which a material to be ground is gripped between upper and lower lapping platens rotated in opposite directions, to simultaneously grind both surfaces of the material.

In each of these known machines, grinding is carried out while continuously supplying a slurry containing a high concentration of abrasive grains onto the surface of the material to be ground. These abrasive grains, however, contaminate the apparatus and equipment, and further, the amount of abrasive grains effectively involved in the grinding is very small, although a large quantity of abrasive grains is used overall, which increases the grinding cost. Also, the waste liquid containing the abrasive grains and grinding residue must be treated before discharge.

To overcome these defects, it has been proposed to mount a solid grinding wheel having abrasive grains incorporated therein on a lapping platen, and perform grinding with a steady supply of water or water containing a small amount of a surface active agent instead of the abrasive grain-containing slurry. This method, however, is defective in that abrasive grains detached from the grinding wheel, and the grinding residue, penetrate fine pores on the surface of the grinding wheel, causing overloading and necessitating frequent dressing operations to prevent a reduction of the grinding power.

SUMMARY OF THE INVENTION

Accordingly, a primary object of the present invention is to provide a surface grinding apparatus in which overloading and a reduction of the grinding power with time are controlled, and by which a material can be uniformly and smoothly ground.

In accordance with the present invention, this object can be attained by a surface grinding apparatus in which a work piece having a plate-like, disc-like, circular or annular shape, and having a flat surface and a uniform thickness, is held by carrier plates between upper and lower horizontal surface tables confronting each other, is pressed against the upper and lower surface tables and the upper and lower surface table and carrier plates are slidingly moved by different rotary actions to grind the work piece by sliding friction. The surface grinding apparatus is characterized in that a plurality of resin bond grinding stones are attached to the upper and lower surface tables directly or through attaching plates such that both of the upper and lower acting surfaces constitute the same plane, the grinding stones are defined by a plurality of grooves formed to extend toward the outer side of the surface table from the inner side thereof in a direction opposite to the direction of rotation of the surface table, and communicate with the outer side of the surface table and a plurality of radial grooves passing through an imaginary center of the surface table; the width of the grooves being at least 4 mm, the depth of the grooves from the grinding surface to the surface of the surface table being at least 5 mm, and the area ratio of the grinding stone-acting surface to the effective grinding surface being at least 50%.

DESCRIPTION OF THE PREFERRED EMBODIMENTS

The apparatus of the present invention will now be described with reference to the accompanying drawings.

Figure 1:
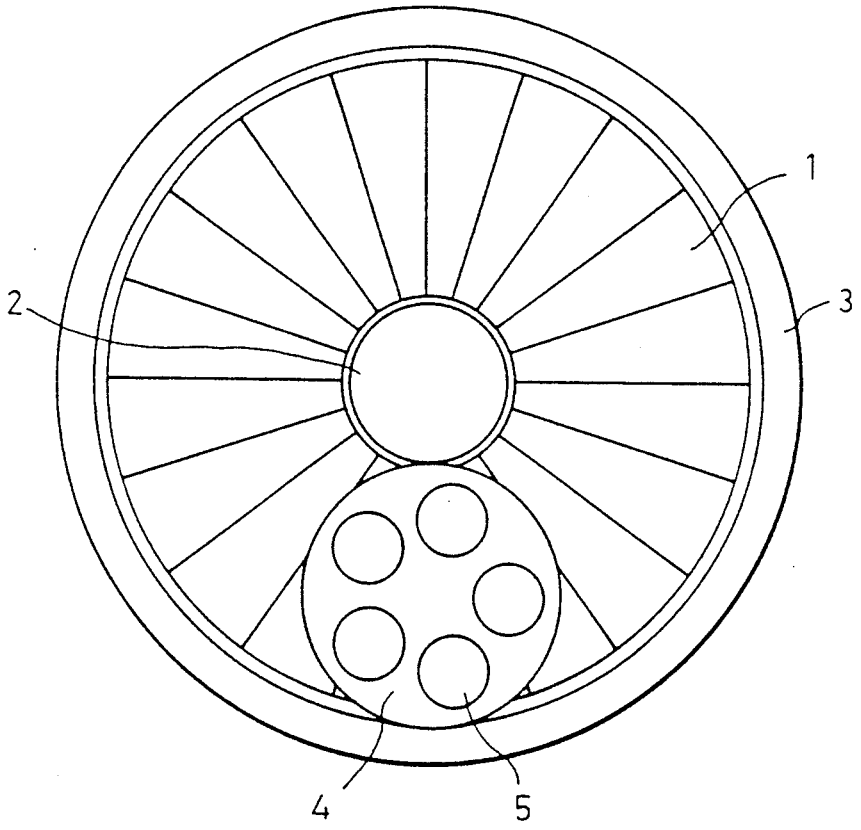
FIG. 1 is a plane view showing the lower surface table of upper and lower horizontal surface tables, which confront one another, as one embodiment of the surface grinding apparatus according to the present invention.

FIG. 1 shows the lower surface table 1 of upper and lower horizontal surface tables, which confronting one another. Reference numeral 2 denotes a sun gear having gear teeth formed on the periphery thereof, 3 denotes an internal gear having gear teeth formed on the inner circumference thereof (teeth not shown in the drawings), and 4 denotes a carrier plate, which is a thin disc-shaped plate having gear teeth to be engaged with the gear teeth formed on the sun gear 2 and internal gear 3 and formed on the periphery thereof. The lower surface table 1, the upper surface table (not shown in the drawings), the sun gear 2, and the internal gear 3 are able to rotate independently from one another. The carrier plate 4 has a structure such that the carrier plate 4 can revolve around the surface table and rotate around its axis, in accordance with movements of the sun gear 2 and internal gear 3. Holes 5 are formed in the carrier plate 4 to hold the work piece.

At the grinding operation, several carrier plates 4 are set on the lower surface table 1 and the work piece is set in the holes 5 formed in the carrier plates. In this state, the upper surface table is brought down, and under an appropriate contact pressure, the upper and lower surface tables, the sun gear 2, and the internal gear 3 are rotated at different speeds, and grinding is accomplished by the resulting sliding friction while a grinding solution is supplied.

According to the present invention, the grinding stones are arranged in the above-mentioned surface table, and each of the upper and lower surface tables are divided into 20 equal trapezoidal portions by radial lines passing through the imaginary center.

Figure 2:
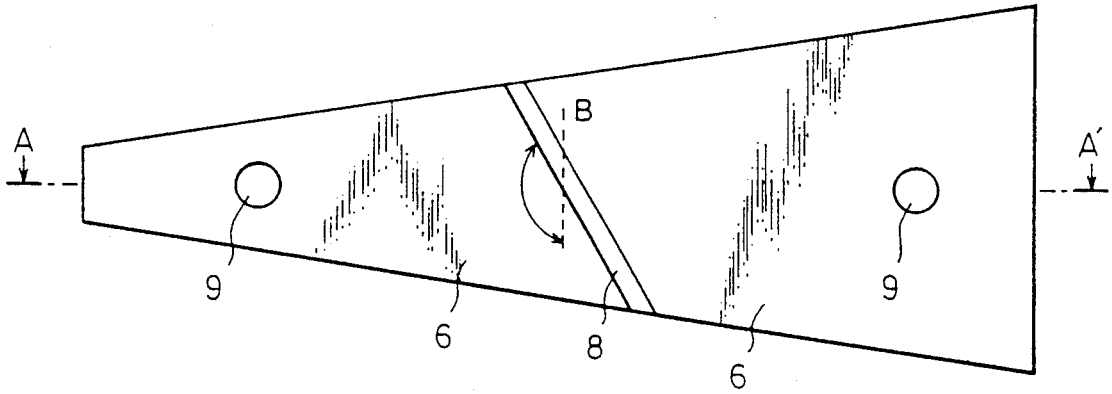
FIG. 2 is a plane view showing the shape of the grinding stone arranged in one trapezoidal portion of the apparatus as shown in FIG. 1.
Figure 3:
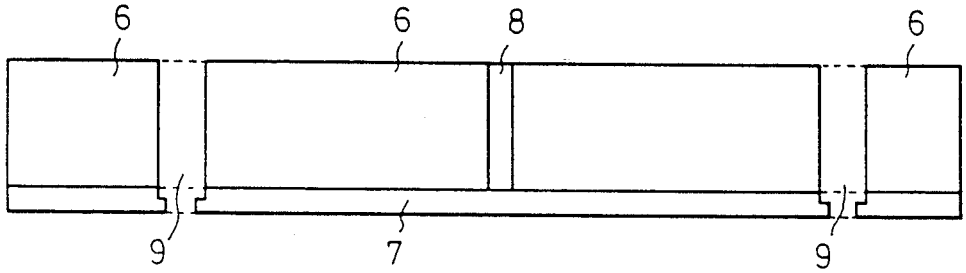
FIG. 3 is a view showing the section taken along the line A—A' in FIG. 2.

FIG. 2 is a plane view showing the shape of the grinding stone arranged in one trapezoidal portion, and FIG. 3 is a view showing the section taken along the line A—A' in FIG. 2. The grinding stone 6 is bonded and fixed, and grooves 8 crossing the grinding stone 6 obliquely are formed. In the shown embodiment, the inclination angle of the grooves to the tangent (B) on an imaginary concentric circle optionally drawn on the surface table is 120°.

Twenty grinding stones having the above-mentioned shape are attached to each of the upper and lower surface tables to form one grinding surface as a whole, and each grinding stone is attached to the surface table by bolts screwed into holes 9 formed in the attaching plate 7 and threaded holes formed in the surface table.

Figure 4:
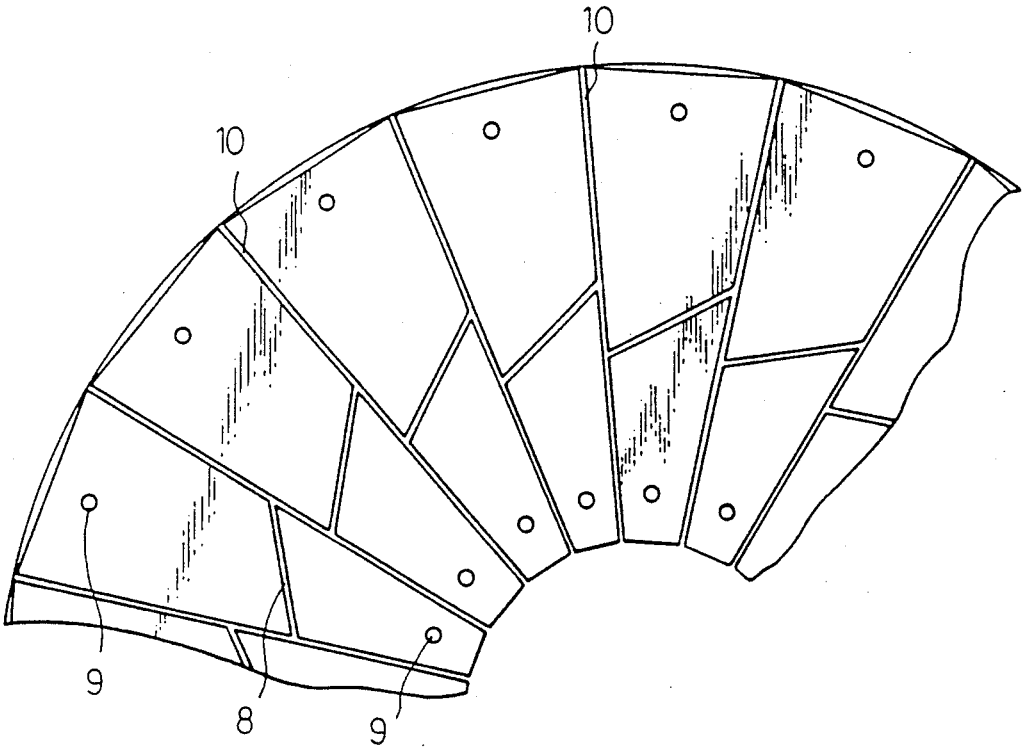
FIG. 4 is a partial view illustrating the attachment of the grinding stone to the surface table as shown in FIG. 1.

FIG. 4 is a partial view illustrating the attachment of the grinding stone to the surface table. When the grinding stones are attached as shown in FIG. 4, a uniform acting surface is formed and a radial groove 10 is formed in the clearances between adjacent stones.

The grinding stone-acting surface formed on each of the surface tables is uniform and flat, and the work piece is set at the carrier plates, and the upper and lower surface tables and the carrier plates are rotated while pressed together, to perform the grinding operation. When the resin bond grinding stones of the present invention are used, grinding grains are detached from the surface of the grinding stones by the grinding operation and new grinding grains contained in the matrix of the grinding stones are caused to appear by self-sharpening action. In other words, the work piece is ground while the grinding stone itself gradually wears. More specifically, while the surface of the work piece is ground by the shearing force of the fixed grinding grains, new grinding grains appear on the surface of the grinding stone, and therefore, a high shearing force can be maintained. During the grinding operation, the exhaust liquid containing the detached grinding grains and resin and fine broken pieces of the work piece is continuously discharged. The above-mentioned grooves effectively prevent the exhaust liquid from remaining on the surface of the grinding stone and clogging the fine pores.

The present invention will be further described in detail with reference to the following examples.

EXAMPLES

A surface grinding apparatus comprising upper and lower horizontal surface tables, which confronting one another and have an action surface having an outer diameter of 990 mm and an inner diameter of 270 mm, was used, and grinding stones having a shape as shown in FIGS. 2 through 4 were attached to the upper and lower surface tables.

Each grinding stone had a thickness of 50 mm, and the width of grooves 8 was 8 mm. The width of each groove 10 formed in the clearances between adjacent trapezoidal grinding stones was 8 mm.

The inclination angle of each groove 8 to the tangent (A) of an imaginary concentric circle optionally drawn on the surface table was 120° (indicated by the arrow in the drawings), and the area ratio of the acting surface of the grinding stones to the effective grinding surface was 85%.

Grinding grains having a grain count number of 1500 according to JIS R-6001 were used for the grinding, and a mixture of a polyvinyl acetal resin, a phenolic resin and a melamine resin was used as the binder. The ratio of the grinding grains to the entire grinding stone was 58% by weight, the void ratio (porosity) was 74% by volume, and the average pore size was 25 microns.

An annular disc of an aluminum alloy having an alloy number of 5086 according to JIS H-4000, and an outer diameter of 5.25 inches, was used as the work piece.

Four carrier plates 4 were set, and 20 of the above-mentioned work pieces were set in the holes formed in the respective carrier plates each having 5 holes.

The grinding operation was carried out under the following conditions, and the surface state of the work piece, the ground quantity, and the state of the grinding surface were observed and measured.

Grinding pressure:
100 g/cm$^2$ (per unit area of work piece)
Rotation number of upper surface table:
23.6 R/M (counterclockwise direction)
Rotation number of lower surface table:
60 R/M (clockwise direction)
Rotation number of sun gear: 28.3 R/M
Rotation number of internal gear: 17.8 R/M
Rotation number of carrier plates:
41.8 R/M (clockwise direction)
Grinding solution: water
Feed rate of grinding solution: 5 ae/min
Time required for grinding: 4 minutes The items of the measurement of the surface of the work piece after the grinding were as follows.

Ra: arithmetic average roughness
Rmax: maximum height
Wcm: maximum weave of filtered wave The above-mentioned polishing test was continuously carried out in ten batches. The results are shown in Table 1.

Figure 5:
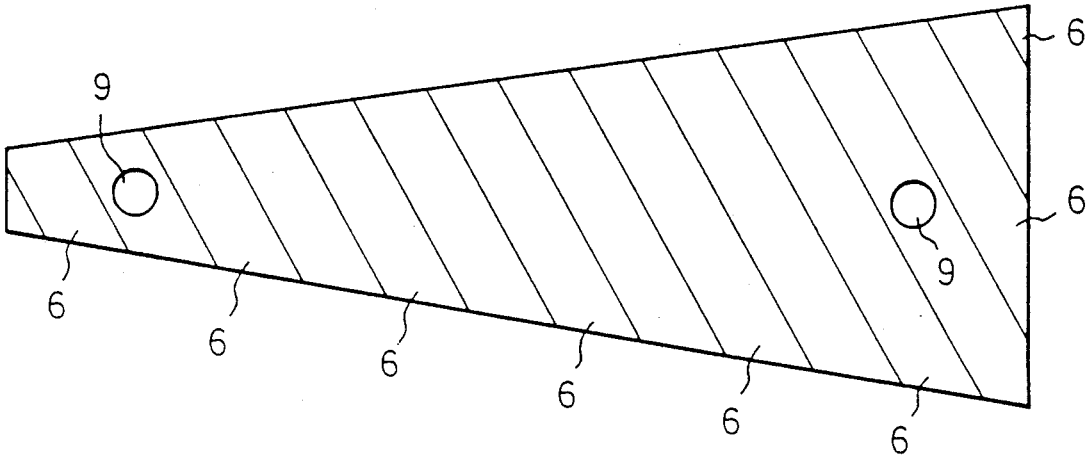
FIG. 5 is a plane view showing the grinding stone arrangement of an apparatus employed in a comparative example.

In Comparative Example 1, the width of each of the grooves 8 and 10 was changed to 3 mm, and in Comparative Example 2, the grinding stones were arranged as shown in FIG. 5 so that the area ratio of the acting surface of the grinding stones to the effective grinding surface was 45%. The other conditions were the same as described above. The results of these comparative examples are shown in Table 1.

As apparent from the results shown in Table 1, when grinding stones having the shape specified in the present invention are used, substantially the same grinding performances can be obtained for the first to 10th batches, and the change of the grinding surface is very small.

On the other hand, if the groove width is narrowed as in Comparative Example 1, loading of the grinding surface occurs before the 5th batch and the grinding power is reduced, and at the 10th batch, no substantial grinding action is manifested and the grinding surface and some grooves are loaded.

If the area ratio of the surface of the grinding stone to the substantial effective grinding surface is reduced as in Comparative Example 2, although loading does not occured, maintenance of the flatness of the entire grinding surface is difficult, and as the batch number increases, the Wcm value is greatly lowered and sagging occurs.

TABLE 1

| | | Example | Comparative Example 1 | Comparative Example 2 |
|---|---|---|---|---|
| First Batch | | | | |
| work piece | Ra (tm) | 0.065 | 0.057 | 0.070 |
| | Rmax (tm) | 0.619 | 0.633 | 0.686 |
| | $W_{CM}$ (tm) | 1.34 | 1.28 | 2.78 |
| | grinding speed (tm/min) | 44.2 | 45.5 | 49.2 |
| | appearance | good | good | slight grinding movements |
| state of surface of grinding stone | | good | good | good |
| Fifth Batch | | | | |
| work piece | Ra (tm) | 0.063 | 0.057 | 0.055 |
| | Rmax (tm) | 0.683 | 0.875 | 0.655 |
| | $W_{CM}$ (tm) | 1.68 | 1.38 | 5.94 |
| | grinding speed (tm/min) | 45.5 | 23.3 | 40.8 |
| | appearance | good | scratches and uneven gloss | uneven grinding and sagging of periphery |
| state of surface of grinding stone | | slightly blackened | blackening, loading of grinding surface and loading of some grooves | low flatness |
| Tenth Batch | | | | |
| work piece | Ra (tm) | 0.057 | 0.052 | 0.072 |
| | Rmax (tm) | 0.702 | 0.698 | 0.663 |
| | $W_{CM}$ (tm) | 1.83 | 2.72 | 16.2 |
| | grinding speed (tm/min) | 40.3 | 0.3 (no grinding power) | 42.3 |
| | appearance | good | conspicuous gloss unevenness | conspicuous loading of periphery |
| state of surface of grinding stone | | slightly blackened | complete clogging of grinding surface and loading of some grooves | very low flatness |

We claim:

1. A surface grinding apparatus in which a work piece having a plate-like, disc-like, circular or annular shape and having a flat surface and a uniform thickness, which is held by carrier plates between upper and lower horizontal surface tables confronting one another, is pressed against the upper and lower surface tables and the upper and lower surface table and carrier plates are slidably moved by different rotary actions to grind the work piece by sliding friction, said surface grinding apparatus being characterized in that a plurality of resin bond grinding stones are attached to the upper and lower surface tables directly or through attaching plates so that both of the upper and lower acting surfaces constitute the same plane, the grinding stones are defined by a plurality of grooves formed to extend toward the outer side of the surface table from the inner side thereof in a direction opposite to the direction of rotation of the surface table and communicate with the outer side of the surface table and a plurality of radial grooves passing through an imaginary center of the surface table, a width of the grooves being at least 4 mm, and an area ratio of the grinding stone-action surface to the effective grinding surface being at least 50%.

2. A surface grinding apparatus as set forth in claim 1, wherein the resin bond grinding stone has a three-dimensional network structure including continuous fine pores, and said network structure comprises a binder composed of a composite comprising a polyvinyl acetal resin as the main component and other thermosetting resin, and fine grinding grains held by the binder.

* * * * *